US009897315B2

(12) United States Patent
Nebbia et al.

(10) Patent No.: US 9,897,315 B2
(45) Date of Patent: Feb. 20, 2018

(54) SAFETY DEVICE AGAINST COMBUSTIBLE GAS LEAKS FOR HOUSEHOLD APPLIANCES

(75) Inventors: Fabio Nebbia, Casale Monferrato (IT); Costanzo Gadini, Casale Monferrato (IT)

(73) Assignee: ELTEK S.p.A., Casale Monferrato (Alessandria) (IT)

( * ) Notice: Subject to any disclaimer, the term of this patent is extended or adjusted under 35 U.S.C. 154(b) by 1646 days.

(21) Appl. No.: 13/383,761

(22) PCT Filed: Jul. 15, 2010

(86) PCT No.: PCT/IB2010/053234

§ 371 (c)(1), (2), (4) Date: Mar. 22, 2012

(87) PCT Pub. No.: WO2011/007331

PCT Pub. Date: Jan. 20, 2011

(65) Prior Publication Data

US 2012/0175539 A1 Jul. 12, 2012

(30) Foreign Application Priority Data

Jul. 17, 2009 (IT) ..... TO2009A0540

(51) Int. Cl.
*F23N 1/02* (2006.01)
*F23N 5/10* (2006.01)
(Continued)

(52) U.S. Cl.
CPC ..... *F23N 5/102* (2013.01); *F23N 5/242* (2013.01); *F24C 3/12* (2013.01);
(Continued)

(58) Field of Classification Search
CPC ..... F23N 5/242; F23N 5/102; F16K 31/02
(Continued)

(56) References Cited

U.S. PATENT DOCUMENTS 4,477,245 A * 10/1984 Giachino ..... F23M 11/045 431/12
5,126,934 A 6/1992 MacFadyen
(Continued)

FOREIGN PATENT DOCUMENTS

FR 1134831 4/1957
GB 2387257 10/2003
(Continued)

OTHER PUBLICATIONS

International Search Report for PCT/IB2010/053234 dated Feb. 7, 2011.
(Continued)

*Primary Examiner* — Avinash Savani
*Assistant Examiner* — Aaron Heyamoto
(74) *Attorney, Agent, or Firm* — Nixon & Vanderhye P.C.

(57) ABSTRACT

A safety device against gas leaks for an apparatus having at least one gas tap or the like (1) includes control means (11), safety means (22) and detection means (12, 53), for detecting possible presence of gas in a surrounding environment. The detection means (12, 53) are in signal communication with the control means (11), which are configured for controlling the safety means (22) in function of detections earned out by the detection means (12, 53), in order to prevent or interrupt the inflow of combustible gas to a burner. The control means (11) and the safety means (22) belong to a first functional unit (A) of the device (A, B), which is coupled or configured for the coupling with a portion of the body (2) of the tap (1). Preferably the safety means (22) are controllable by the control means (11) for interrupting electric power supply to a solenoid of the tap, following a command signal generated by the detection means (12, 53) and causing as a consequence the passage of the valve in the respective closed condition.

21 Claims, 8 Drawing Sheets

(51) Int. Cl.
*F23N 5/24* (2006.01)
*F24C 3/12* (2006.01)

(52) U.S. Cl.
CPC ..... *F23M 2900/11021* (2013.01); *F23N 2031/18* (2013.01); *F23N 2031/20* (2013.01); *F23N 2035/14* (2013.01)

(58) Field of Classification Search
USPC ..... 431/78, 77, 80, 81; 251/129.09
See application file for complete search history.

(56) References Cited

U.S. PATENT DOCUMENTS 5,670,074 A 9/1997 Kass et al.
7,051,683 B1 * 5/2006 Lee ..... F23N 5/242 122/14.21
2001/0038986 A1 11/2001 Abraham
2001/0042564 A1 11/2001 Abraham
2005/0092066 A1 5/2005 Ruhland
2005/0120980 A1 6/2005 Dolan
2006/0166154 A1 * 7/2006 Park ..... F23N 5/146 431/86
2007/0215066 A1 * 9/2007 Garrabrant ..... F23N 5/242 122/14.1

FOREIGN PATENT DOCUMENTS

TW GB 2505213 A * 2/2014 ..... F24C 3/126
WO WO 04/001292 12/2003
WO WO 2004/027320 1/2004

OTHER PUBLICATIONS

Written Opinion of the International Searching Authority dated Feb. 7, 2011.

* cited by examiner

SAFETY DEVICE AGAINST COMBUSTIBLE GAS LEAKS FOR HOUSEHOLD APPLIANCES

This application is the U.S. national phase of International Application No. PCT/162010/053234 filed 15 Jul. 2010 which designated the U.S. and claims priority to IT TO2009A000540 filed 17 Jul. 2009, the entire contents of each of which are hereby incorporated by reference.

FIELD OF THE INVENTION

The present invention refers to a safety device against gas leaks or emissions, for a household appliance having one or more gas burners, or similar flame generators supplied with gas. More particularly, the invention regards such device configured for interrupting the inflow of gas to a burner supplied through a respective tap or valve, in case of detection of presence of gas deemed potentially dangerous in the environment surrounding the burner.

PRIOR ART

Safety devices against gas leaks for use in the domestic field are known. The known devices used in the household field comprise safety means typically constituted by an electric gas valve, whose closure is controlled in function of signals coming from a gas sensor. The solenoid valve is mounted between a point for drawing gas from the household supply system and a supply pipe of the entire apparatus, whether it is provided with one burner (for example a boiler or a water heater) or a plurality of burners (for example a cooker). The gas sensor, which is connected to the solenoid valve through wiring, is mounted alongside the control circuitry of the valve in a built-in box or prearranged to be wall-mounted; usually at about 20-30 cm from the ceiling or from the floor of the installation room. The different height positioning of the sensor box essentially depends on the type of gas subjected to detection, depending on whether this is a gas which tends to rise or fall, when released into an environment.

A typical drawback of the prior art lies in the fact of having to provide for the use of the abovementioned sensors already during the step of defining the household electric system, in order to prearrange suitable walled electric ducts for the passage of wires, both in terms of positioning the sensors and positioning the abovementioned valve arranged on the conduit of the gas supply system. Furthermore, the solenoid valve has considerable overall dimensions, hence often implying installation difficulties, in particular in case of built-in electric appliances, such as cooking hobs. In addition, such gas solenoid valves typically provide for a manual reset or restoration, for the purposes of safety after an intervention, which is complicated by the positioning of the solenoid valve itself in the cabinets in which the built-in domestic appliances are mounted. The mounting of the gas solenoid valve also implies an additional cost, which sums up to the cost of the relative installation, often increased by the abovementioned difficulties related to positioning thereof.

SUMMARY OF THE INVENTION

Considering the above, the present invention has the aim of providing a safety device having a simple structure, small in size, easy to assemble, inexpensive, easily accessible and versatile to application.

These and other objects, which shall be clearer hereinafter, are attained according to the present invention by a safety device having the characteristics indicated in claim 1. Preferred characteristics of the invention are indicated in the sub-claims. The claims form integral part of the technical disclosure provided herein in relation to the invention.

BRIEF DESCRIPTION OF THE DRAWINGS

Further objects, characteristics and advantages of the present invention shall be apparent from the detailed description that follows and from the attached drawings, purely provided by way of exemplifying and non-limiting example, wherein.

DESCRIPTION OF PREFERRED EMBODIMENTS OF THE INVENTION

Reference to "an embodiment" in this description indicates that a particular configuration, structure or characteristic described regarding the embodiment is included in at least one embodiment. Hence, expressions such as "in an embodiment" and the like, present in various parts of this description, do not necessarily refer to the same embodiment. Furthermore, particular configurations, structures or characteristics may be combined in any suitable manner in one or more embodiments. References herein are used for facilitating the reader and thus they do not define the scope of protection or the range of the embodiments.

Figure 1:
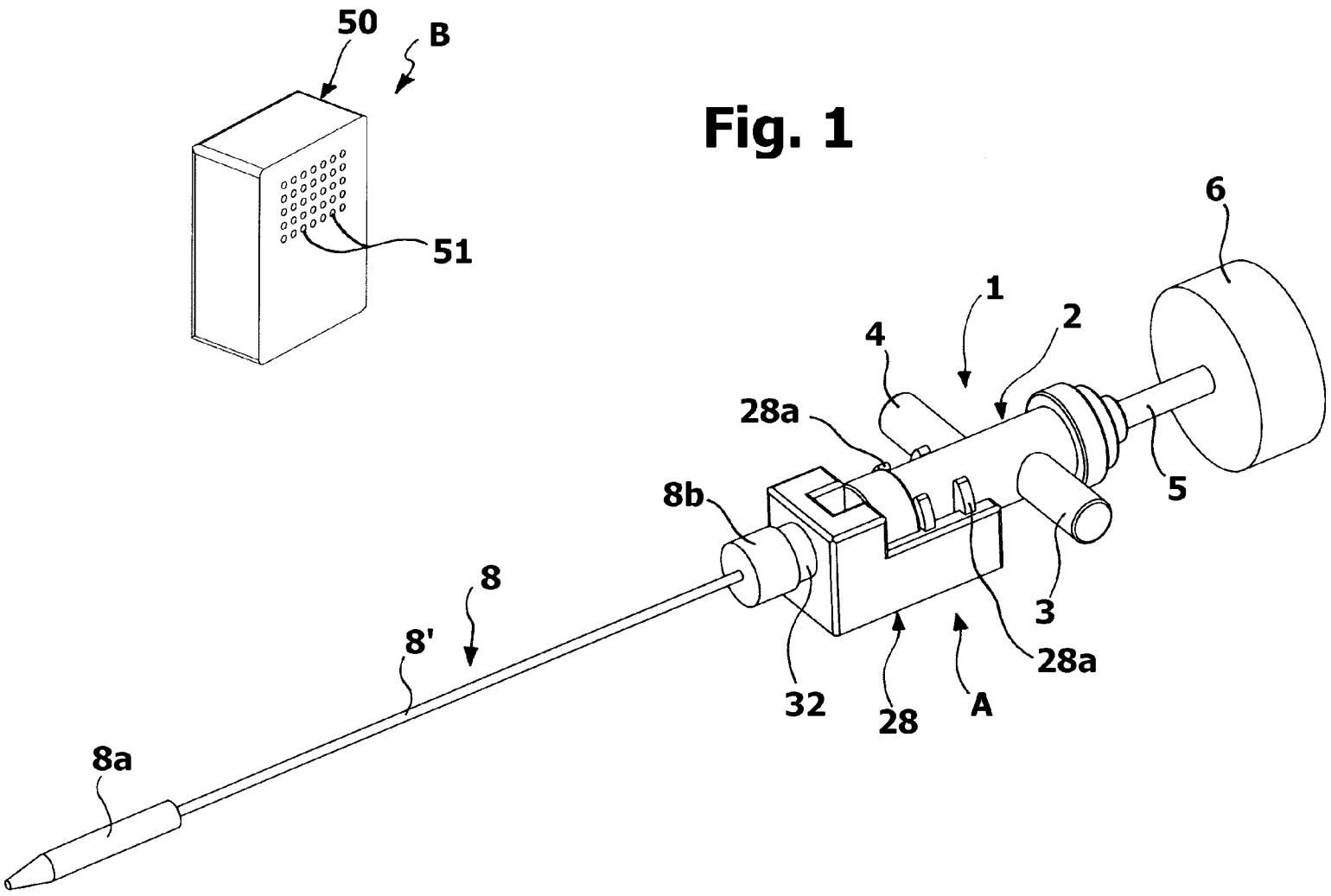
FIG. 1 is a perspective view, partial and schematic, of a tap or gas valve with a device according to the present invention associated.
Figure 2:
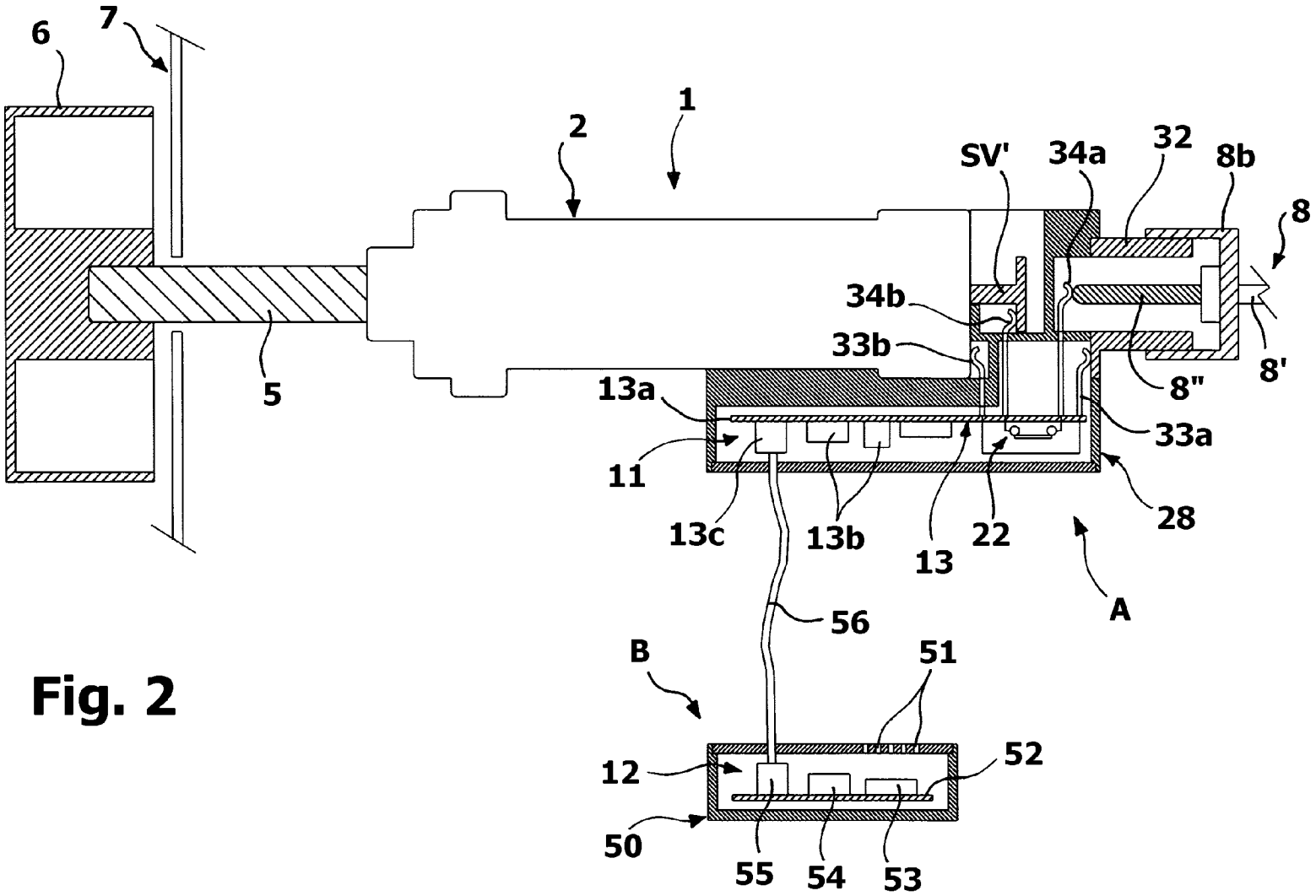
FIG. 2 is a schematic section of the gas tap and of the safety device of FIG. 1.

In FIGS. 1 and 2, reference 1 indicates as a whole a gas tap or valve, of a generally known design, having a tap body 2, preferably made of metal material and configured for being connected on a combustible gas supply line to a single gas burner, or similar gas combustor, of a generic apparatus, herein assumed to be a household cooking appliance, such as a cooking hob or an oven; the invention may however be applied to other types of apparatus provided with at least one burner, such as household heating and/or water and sanitary apparatus (such as wall boilers or a gas water heater).

For such purpose, the tap body 2 is provided with an inlet 3, intended for connection to a gas supply line, not represented, and an outlet 4, intended to be connected to a conduit, also not represented, for delivering the gas to the burner controlled by the tap 1. Means for adjusting the gas flow admitted from the inlet 3 to the outlet 4, of per se known design, constituted for example by a shutter adjustable in position through a manoeuvring shaft 5 are mounted in the tap body 2. The abovementioned shaft 5 projects axially from a proximal end of the tap body 2 and is adapted to rotate around its axis, with the aim of attaining the abovementioned adjustment of the gas flow. A respective control means, which in the example is constituted by a knob 6, is coupled to the manoeuvring shaft 5; a rotation imparted manually to the knob 6 causes the rotation of the shaft 5, and thus the abovementioned adjustment of the gas flow, all according to a well-known technique.

As observable in FIG. 2, in the installed condition of the tap 1, at least one substantial or main portion of the body 2 (and preferably substantially the entire body 2), is positioned in the structure or cabinet of the apparatus, represented solely partly and schematically indicated with 7. The tap is fixed according to a known technique to the structure 7 through suitable means, not represented. FIG. 2 also shows how, in the abovementioned installed condition of the tap 1, the knob 6 is located outside the structure 7, so as to allow manual operation of the apparatus by the user.

The tap 1 is internally provided with a safety valve, not shown, suitable to be maintained in the respective open condition through an electromagnet or solenoid. Such valve is conceived in a manner well known in the art, and thus it shall not be described in detail herein. In this case, it should be simply pointed out that such valve is of the open/closed type, to allow or hinder the flow of gas to the burner, respectively. The solenoid of the valve is supplied through a thermoelectric generator which, in the example represented in the figures, is made up of a thermocouple 8, connected to a distal end of the tap body; the thermocouple has a sensitive part 8*a*, or hot joint, intended to be installed in proximity to the burner controlled by the tap 1, such burner being represented solely schematically in FIG. 5, where it is indicated with 9.

Like in the prior art, when the burner 9 is ON, the sensitive part 8*a* of the thermocouple 8 generates an electric voltage and/or current in response to the heat generated by the flame on the burner 9. This current supplies the solenoid of the abovementioned safety valve, which maintains the shutter of the latter (associated to a moveable core attracted by the solenoid) in the respective open condition, countering the action of a spring. Thus, substantially, as long as the burner is ON, the current is generated and the solenoid keeps the valve open; when the burner 9 is switched OFF manually, or goes OFF inadvertently, the power supply to the solenoid is interrupted, and the valve is closed, thus actuated by the abovementioned spring, in such a manner to prevent the passage of the gas between the inlet 3 and the outlet 4 of the tap body 2.

Due to the abovementioned reasons, in an embodiment, the tap 1 is of the type wherein the manoeuvring shaft 5 is suitable to translate along its axis, in an actuation direction, against the action of elastic means inside the tap body 2. Such translation or sliding is obtainable by pressing the knob 6 towards the tap body 2, or towards the structure 7, after initially rotating the knob 6 in such a manner to allow a flow of gas to the burner. Thus, the axial displacement of the shaft 5, caused manually by operating on the knob 6, causes an initial opening of the safety valve; the knob is kept in the pressed condition until the flame is ignited on the burner: as mentioned, in the presence of the flame, the thermocouple 8 generates the current which, through the solenoid, keeps the valve in the open condition; thus, after igniting the flame, the user may release the knob 6.

In an embodiment, operatively associated to the tap 1 is a gas igniter system, of the type suitable to generate sparks in proximity to the burner, so as to ignite the flame. Also such igniter system is conceived in a manner per se known in the art, and thus it shall not be described herein. In this case, it should be simply pointed out that the igniter system comprises two control terminals, indicated with S+ and S− in FIG. 5, belonging to a circuit including two electrodes of the known type, not represented, generated between which are the abovementioned sparks following an electric discharge. Advantageously, and according to per se known art, the igniter may be activated exploiting the configuration of the tap 1, and specifically the possibility of the manoeuvring shaft 5 to slide or translate along its own axis. Therefore, pressing the knob 6 after rotating it at least slightly, alongside causing the initial opening of the safety valve also causes the activation of the abovementioned igniter system, through a switch or electric contact, mentioned hereinafter.

In FIGS. 1 and 2, two functional units part of a safety device against gas leaks or emissions, constituting the specific object of the present invention, are indicated in their entirety with A and B. Such device is prearranged to perform at least one safety function with respect to a single or respective burner, and it includes for such purpose control means, belonging to the functional unit A, and detection means, belonging to the functional unit B, the control means and the detection means being indicated in their entirety with 11 and 12, respectively, in FIG. 2.

According to a preferred feature of the invention, the control means 11 of unit A, connected in signal communication with the detection means 12 of unit B, are prearranged to control safety means adapted to interrupt or however control electric power supply to the solenoid of the abovementioned safety valve, should the detection means 12 detect a presence of a gas deemed potentially dangerous, such as a combustible gas, and thus cause the passage of the valve itself to the respective closed condition. According to the invention, the unit A, to which the control means 11 belong, is at least partly coupled or configured for the coupling with a portion of the tap body 2, preferably a portion of the body 2 which, in the installed condition of the tap 1 and of the device, is inside the structure 7 of the apparatus.

In the illustrated non-limiting embodiment, the abovementioned safety means comprise electric switch means, connected in series between at least one electric connection of the thermoelectric generator, or the thermocouple 8, and the solenoid of the safety valve.

In the currently preferred version, the control means 11 include a circuit arrangement, particularly an electronic circuit, generally indicated with 13 in FIG. 2, which also integrates the abovementioned safety means. In the example, such circuit arrangement 13 comprises a printed circuit board or PCB, indicated with 13*a*, mounted on which are the circuit components, some of which indicated with 13*b*. In the preferred, though not exclusive, embodiment of the invention, the circuit arrangement is also conceived with the aim of controlling the igniter system S+, S− of the flame on the burner 9.

The circuit 13, which receives signals from the detection means 12 and which thus controls the safety means, is obtainable through any known method, and thus it shall not be described in detail herein. In this case, it should be simply pointed out that such circuit preferably comprises means, for example at least one integrated circuit or a microcontroller adapted to control at least one controllable electric or electronic device, which provides the safety means, the device being suitable to be controlled to open or vary the electric circuit of the thermocouple 8.

In an embodiment, described hereinafter, the abovementioned controllable device is made up of a switch, of the electro-mechanical type (for example a relay) or of the electronic type (for example a mosfet or a triac), controllable to open the electric circuit of the thermocouple 8. According to possible variants, the abovementioned controllable device is configured to vary the electric circuit of the thermocouple 8 or the solenoid, and comprise for example a device configured for cutting off or controlling the power supply of the solenoid by short-circuiting the terminals of the thermocouple, or by inserting—in parallel—a load or resistor that reduces the current to the solenoid.

In a possible embodiment, not represented, the thermocouple 8 is not connected directly to the solenoid SV, or the signal of the thermocouple is detected by an electronic circuit configured for controlling as a consequence the solenoid; such circuit may be part of the device according to the invention, which detects the signal of the thermocouple and processes it, then controlling the solenoid.

Also the circuit part related to the igniter system S+, S− may be obtained in any known manner, preferably integrated at least partly in the circuit arrangement 13, in particular, providing for—in such arrangement—at least one device or control element of the igniter system.

In the example represented in FIGS. 1 and 2, the functional unit B comprises a box-shaped casing 50, for example made of moulded thermoplastic material, in which the detection means 12 are housed. Preferably, holes or passages 51 are formed in at least one wall of the casing 50, which place the interior of the casing itself with the external environment in communication, for the detection of possible presence of gas in the environment; in a possible embodiment—not shown—the unit B also includes suctioning or forced ventilation means, for facilitating movement or circulation of the gas to be detected, in particular inside the casing 50 and/or near the detection means 12.

The detection means 12 include a circuit arrangement, particularly an electronic circuit, indicated with 52 in FIG. 2. In the example, such circuit arrangement 52 comprises a printed circuit board or PCB on which the required electric and/or electronic components are mounted. Also circuit 52, which is prearranged at least to send signals to the control means 11 of the functional unit A, is obtainable through any known method, and thus it shall not be described in detail herein. In this case, it should be simply pointed out that, in the shown example, the circuit 13 comprises at least one sensor or gas detector, indicated with 53, an integrated circuit or a microcontroller 54 and a connection or interface element 55 for a multipolar electric wire, indicated with 56, for connection to a homologous connection or interfacing element 13*c* present in the circuit 13 of the functional unit A; the wire 56 is used for power supplying the circuit 52 and for transporting signals at least from circuit 52 to circuit 13.

The communication format or protocol between units A and B may be of any type, standard or proprietary, with a transmission of data not necessarily serial, preferably but not necessarily of the bidirectional type. Actually, in possible embodiments, the device according to the invention may be prearranged in such a manner that unit B may also receive information or data, for example calibration and/or synchronisation control data, such as for example a control for enabling the transmission of the value measured by the sensor 53; therefore, if required, unit B may receive information from unit A or from another device, such as an external programming device.

The sensor 53 may be a sensor of the per se known type, suitable to be used for detecting the presence and the amount/concentration of gas. In an embodiment the sensor 53 is a MOS (Metal Oxide Semiconductor) sensor, for example comprising a ceramic support containing a heater element, the support and the heater element being covered by a semiconductor metal oxide film (typically tin, gallium, or titanium oxides). The deposited oxide or oxides may be n-type or -type semiconductors, in function of the type of gas to be detected (respectively oxidising or reducing molecules); such oxides may also be doped with other metals or other oxides to increase sensitivity and selectivity towards given chemical species, or for reducing the influence on the measurement regarding humidity and temperature. A sensor of this type may be also provided through MEMS technology.

Another type of sensors useable for the purpose is that of the MOSFET (Metal Oxide Semiconductor Field Effect Transistor) or GASFET (Gas Sensitive Field Effect Transistor) sensors, which are also sensors based on metal oxides, but with a structure similar to a transistor; these sensors are generally constituted by three deposited layers: silicon semiconductor, insulating silicon oxide and a metal catalyst (platinum, palladium, rhodium, iridium). During operation, the interaction of the metal with the vapour to be analysed triggers a modification in the current of the transistor generating a detectable variation of electrical resistance.

The sensor 53 may possibly be a conductive polymer sensor. The sensitive element may be constituted by a per seconductive polymer (polypyrrole, polyaniline) or by a deposition of conductive carbon black. Such compounds are thus suitably doped with non-conductive organic molecules, with the aim of heightening selectivity and sensitivity towards a specific chemical species. The conductive polymers sensors are characterized by a conductivity variation when exposed to sensitive volatile substances; the absorption of the gas molecule causes a swelling of the components of the conductive film and an ensuing alteration in the resistivity value of the sensor.

The use of types of gas sensors different from the indicated ones, such as for example optical sensors which exploit the absorption of a part of a light beam by the gas to be detected, is included in the scope of protection of the invention.

In the embodiment exemplified in FIG. 2 a respective detection unit B is connected to the control unit A, through the wiring 56; however, as apparent hereinafter, several control units A may be associated to the same detection unit B. In a variant embodiment, several detection units B, for example located at different positions, may be associated to the same control unit A or to several control units A. In any case, the unit B may be installed at the detection point deemed suitable, both in the environment in which the apparatus is installed and within the apparatus itself.

Figure 5:
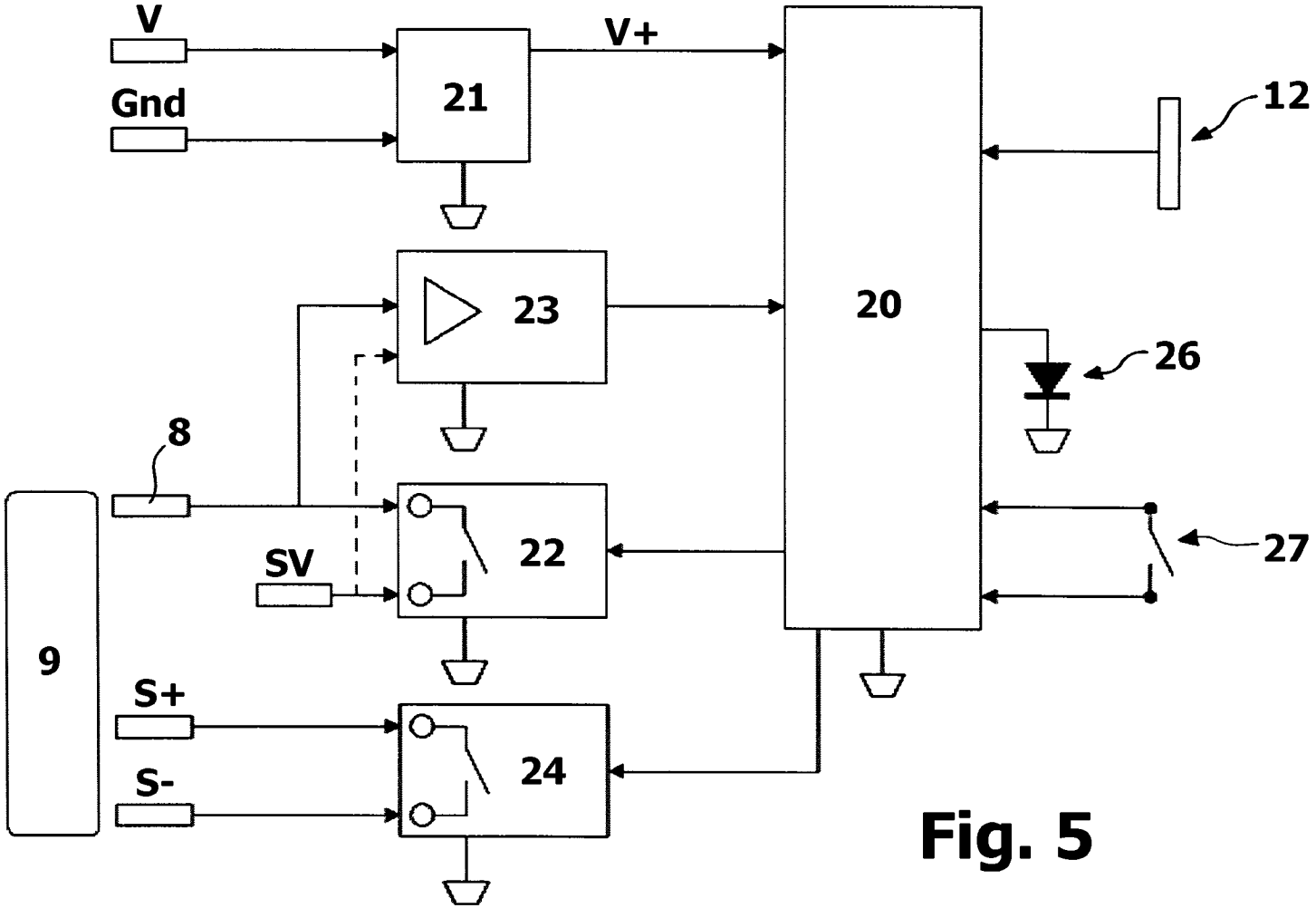
FIG. 5 is a simplified circuit diagram of the safety device of FIGS. 1-4.

FIG. 5 represents a possible simplified diagram of the circuit arrangement of the device according to the invention. In such FIG. 5, indicated with 20 is a control circuit, for example made up of a commercial microcontroller, which is supplied with low direct voltage (for example 3-12 Vdc) through a stabilized power supply stage indicated with 21, conceived in a known manner. The stage 21 receives electric voltage from the power supply system, or from another electrical power generator of the apparatus, whose positive and ground poles are indicated with V and GND, respectively.

Indicated with 8 and SV are the abovementioned thermocouple and the aforementioned solenoid of the safety valve of the tap 1, or at least two respective points of connection that are connected together in series or in parallel, with the interposition of the abovementioned controllable device, herein represented for exemplifying and non-limiting purposes by a switch 22, such as a relay or a mosfet.

The switch 22, preferably but not necessarily of the normally open type, is switchable through a pulse or signal commanded by the timing circuit 20.

Preferably connected to the circuit of thermocouple 8 and/or the solenoid SV is a sensor 23, such as a current sensor, for example made up of a shunt resistor in series on the circuit, on the tips of which the electric voltage proportional to the circulating electric current is detected (according to a possible variant, described hereinafter, the sensor 23 may be a voltage sensor).

Indicated with S+ and S− are the aforementioned electric terminals of the gas igniter system, including the electrodes generated between which is the spark suitable to ignite the gas on the burner 9. The two terminals S+ and S− are connected in series through a further controllable electric or electronic device, herein described for exemplifying and non-limiting purposes by a switch 24, such as a relay or a mosfet, or another switch or electronic control element. Also the switch 24, preferably of the normally open type, is switchable through a pulse or signal generated by the circuit 20, which is preferably configured also with the aim of controlling the igniter system.

Indicated with 12 are the abovementioned detection means, in signal communication with the control circuit 20, so as to provide the latter with information of possible presence of gases deemed dangerous in the environment.

Still in FIG. 5, indicated with 26 are signalling means, made up of a light source, for example a light emitting diode, or LEDs, suitable to generate—under the control of the circuit 20—light signals useful for the user of the device 10, such as the occurred safety intervention of the device according to the invention; additionally or alternatively, the device according to the invention may be provided with display or signalling means of another type, even of the acoustic type.

Indicated with 27 is a command element, not represented in the other figures, adapted for providing a command signal.

In the illustrated non-limiting example, the command element 27 is represented by a switch, which may be operatively associated to the shaft 5 of the tap or to the knob 6, so as to be switched when the knob 6 is pressed, when opening the tap 1. The switch 27 may also be of the type installed at a position separated from the tap 1, for example made up of a button mounted on the structure 7 at a position operable by a user. In an embodiment, the control element or switch 27 is used for providing a command signal to the circuit 20; advantageously, the element 27 may also be exploited for controlling other devices of the user apparatus 7, such as in particular the gas igniter S+, S−.

Figure 4:
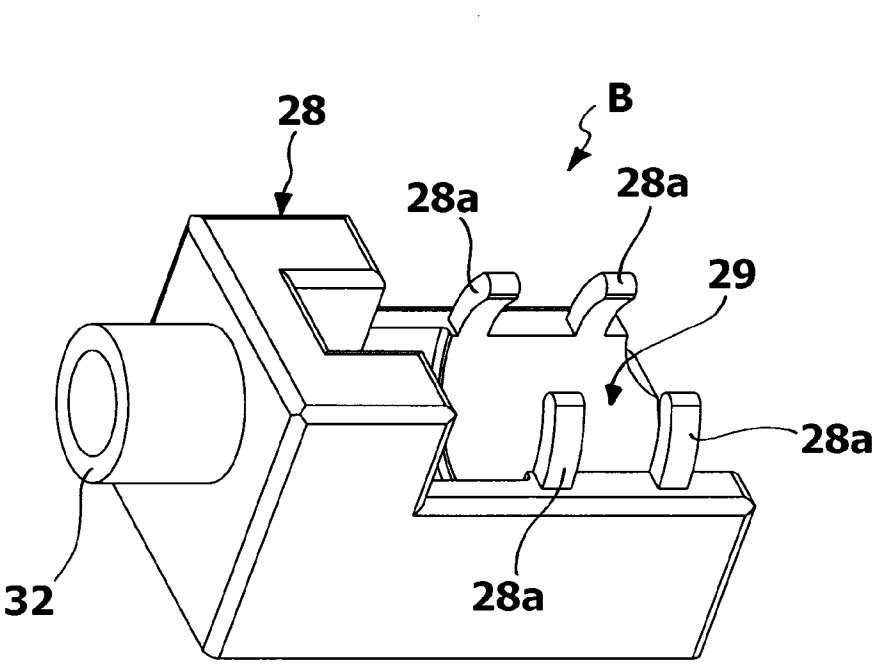
FIGS. 3 and 4 are two schematic perspective views of a functional unit of the safety device of FIGS. 1 and 2.
Figure 3:
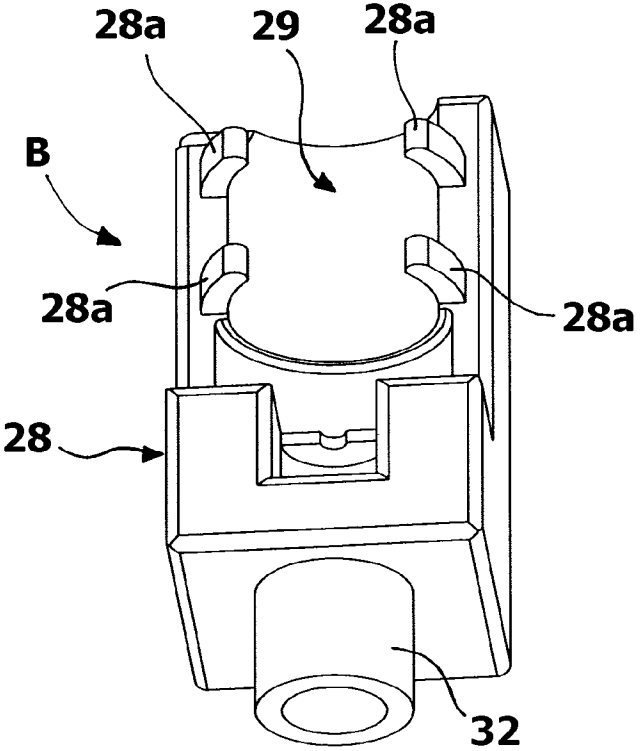

In FIGS. 2-4, indicated with 28 is the body of the functional unit A of the device according to the invention, housed in which is the circuit arrangement 13. The represented body 28 is configured for the coupling with the tap body 2 and provided therein for such purpose are coupling means 28*a*, which allow coupling the body 28 to the tap body 2. In the example, these coupling means are configured as elastic hooks, which allow a substantially snap or quick coupling between the bodies 28 and 2, but obviously, the configuration of such means may be different. In the example, the body 28, made—at least partly—of insulating material, such as moulded thermoplastic material, defines a seat or blind cavity 29, configured for housing—at least partly—the tap body 2: thus, the body 28 may be fitted laterally into the body 2. The cavity 29 preferably has a profile matching, particularly substantially complementary, to that of the part of the body 2 received therein.

In the normal use of the tap 1, the user rotates the knob 6 and presses it, to produce the initial opening of the abovementioned safety valve. It should be borne in mind that, referring to the described embodiment, pressing the knob 6 also causes the switching of the control element 27 which, in the example serves to generate a command signal for the circuit 20 of FIG. 5.

The circuit of FIG. 5 is preferably configured to guarantee low consumption in the respective stand-by condition and is "woken-up" by the switching of the command element 27. In a preferred example of operation, following such switching of the element, the circuit 20:

- controls closure of the switch 22, which thus connects the thermocouple 8 to the winding of the solenoid SV of the safety valve; the switch 22 is kept at the closed condition;
- controls the closure of the switch 24, with the ensuing generation between the electrodes connected to the terminals S+, S−, of the spark which causes ignition of the flame; after the pulse, the switch 24 reopens;
- after a short wake-up time interval, it monitors—through the sensor 23—the presence of current, indicating the closure of the electric circuit and the ensuing activation of the solenoid SV and of the flame at the burner 9 (as mentioned, the sensor 23 could be a voltage sensor: in such case, the sensor 23 monitors the presence of voltage generated by the thermocouple 8, indicating the actual ignition of the flame on the burner 9, and hence the actuation of the solenoid SV).

As mentioned, the heat generated by the flame has the consequence lying in the fact that the sensitive part 8*a* of the thermocouple generates the current required to keep the safety valve open, given the closed condition of the switch 22. In such condition, the sensor 23 detects the presence of the current (or voltage) generated by the thermocouple 8, and the respective signal is acquired by the circuit 20. However, it should be borne in mind that the safety sensor 23 could also be absent.

In case of detection, through the sensor 53 of the functional unit B, of presence or concentration of gases deemed potentially dangerous, for example unburnt combustible gas, the circuit 52 sends a corresponding intervention signal to the control means 11 of the functional unit A, and specifically to the circuit 20. After receiving such signal, the circuit 20 generates a signal or pulse for switching the switch 22, causing opening thereof: in such manner, the thermocouple 8—solenoid SV circuit is open, with the ensuing closure of the safety valve of the tap 1: the burner 9 thus goes OFF.

In an embodiment of the invention, the functional unit A is advantageously configured to facilitate quick connection between the module itself and the thermocouple. For such purpose, in the example shown, in the body 28 of the unit A has, at the distal end, a connector element, such as a tubular component 32, made of electrically conductive material, for example metal, threaded externally or however equipped with an electrical and/or mechanical coupling with an end connection element 8*b* of the thermocouple 8, such element 8*b* preferably being of the standard type, for example in form of an internally threaded bushing. The body 28 of the unit 10 may be possibly moulded or ovemoulded on the component 32.

In the example, the unit A is also provided with electric contacts aimed at allowing a quick electric connection between the electric parts of the unit A, and in particular at least the switch 22, the solenoid of the safety valve and the thermocouple.

For such purpose, indicated with 33*a* and 33*b* are two ground contacts, associated to the circuit 13, arranged for connecting the component 32 (and thus the ground conductor 8' of the thermocouple 8) to the tap body 2 (and thus to the ground of the solenoid).

Indicated with 34*a* and 34*b* are two further contacts, which are respectively coupled to the phase terminal of the solenoid, indicated with SV', projecting from the distal end of the body of the tap 2, and the central conductor 8" of the thermocouple 8. As observable, in the represented example, connected in series between the two contacts 34*a*-34*b* is the switch 22 (as a non-illustrated variant, interposed between the terminals 33*a* and 33*b* could be a controllable device or switch or commanded element analogous to that indicated with 22).

As evincible, through this arrangement, the body 28 of the unit A may be fitted onto the tap body 2, thus obtaining the connection of the contacts 33*b* and 34*b* to the tap body 2 and to the terminal SV' of the solenoid, respectively. Then, the bushing 8*b* is screwed onto the bottom of the component 23, hence also obtaining the electric connection of the conductors 8' and 8" of the thermocouple 8.

In the exemplified embodiment, the various contacts 33*a*-33*b* and 34*a*-34*b* are configured as plate contacts, projecting from the terminal board 13*a* towards the interior of the cavity 29 of the body 28 of the unit A, into which the tap 1 is coupled. Obviously, the abovementioned contacts could be shaped or configured a manner different from the illustrated one and/or be connected to different control means 22.

Figure 6:
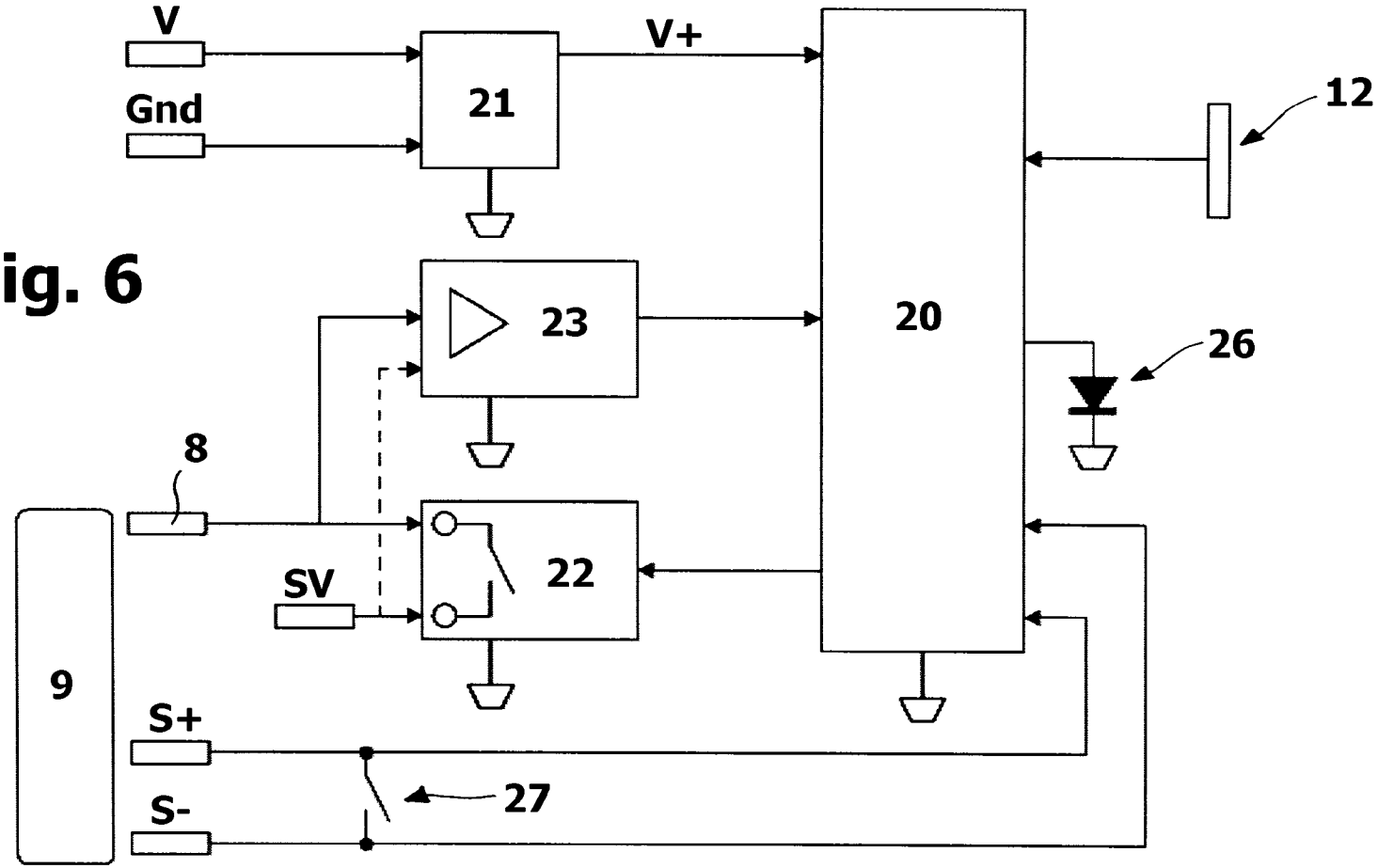
FIG. 6 is a simplified circuit diagram of the safety device according to a second embodiment of the invention.

Illustrated in FIG. 6 is a possible simplified electrical diagram according to an embodiment, which is mostly similar to that of FIG. 5. The only considerable difference lies in the fact that provided for in this case is only one controllable device or switch 22, which serves the functions described beforehand, while the functions of the controllable device or switch 24 of FIG. 5 in this case are directly performed by the command element or switch 27 which, even in this case, may for example be directly controlled through the axial displacement of the manoeuvring shaft 5 of the tap, when it is pressed; in such example, the control element or switch 27 is connected in parallel both to the terminals S+, S− of the igniter module and to the module or circuit 20. The operation of the device, in such embodiment, is substantially analogous to that described previously.

Figure 7:
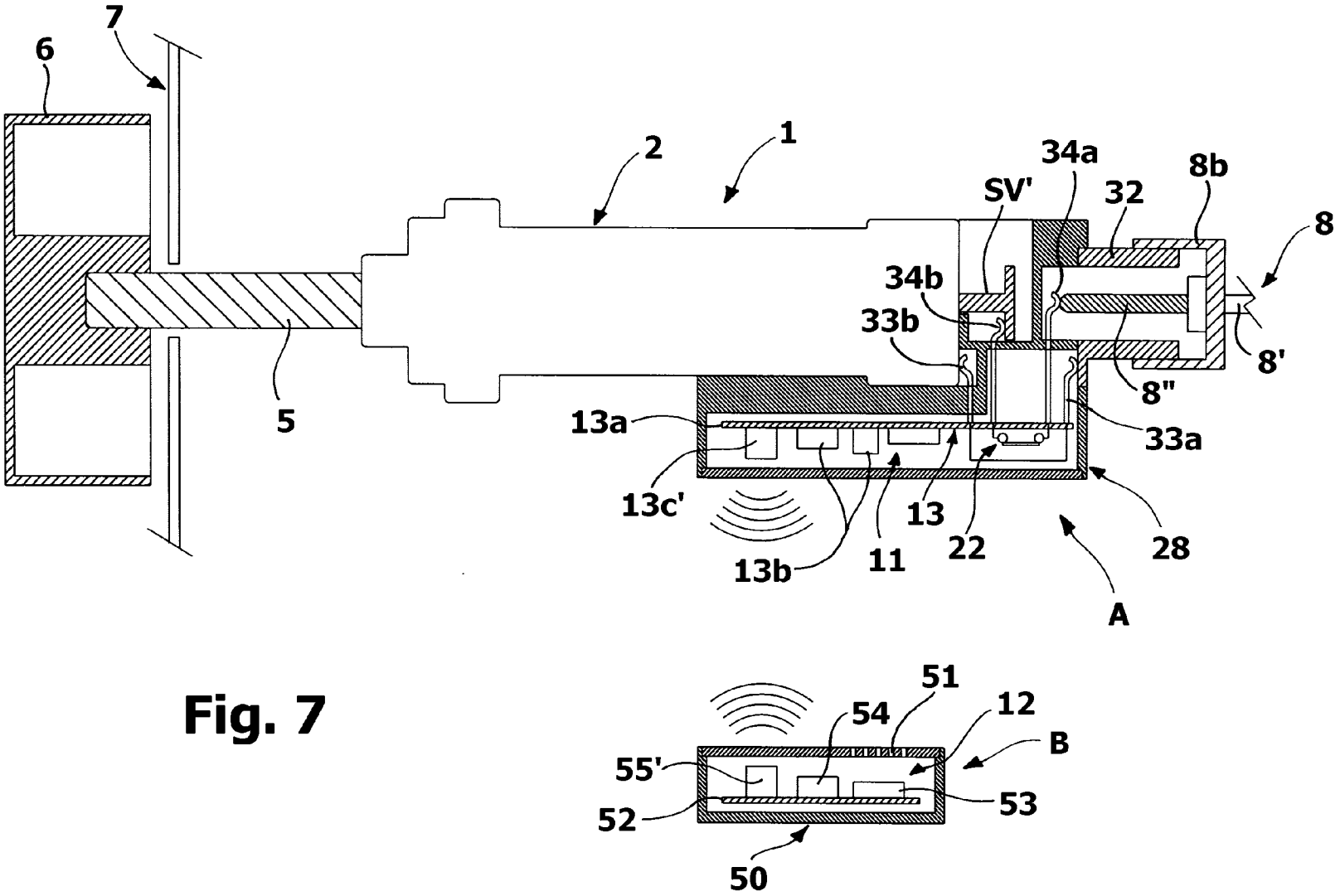
FIG. 7 is a schematic section similar to that of FIG. 2, relative to a third embodiment of the invention.

Illustrated in FIG. 7 is an embodiment alternative to that of FIG. 2, according to which the connection of units A and B is not of the wired type, the control means and the detection means being provided with communication means of the wireless type; in such embodiment, the communication of data between the two units occurs in a wireless manner, such as for example a radiofrequency or RF communication.

For such purpose, the interfacing elements 13*c*, 55 and the wire 56 of FIG. 2 are replaced by a wireless transmitter 55' and a wireless receiver 13*c*', for example operating in radiofrequency or infrared manner (the components 55' and 13*c*' may be made up of wireless transceiver means considering that, as mentioned, in possible embodiments of the invention even unit B is configured to receive information or data, from the unit A or another external device).

In such embodiment, the functional unit B is preferably provided with its own autonomous source of power supply, such as a battery, or it is fed through the electrical power supply system (in which case the circuit 52 is preferably provided with a suitable supply stage).

In a possible embodiment, in particular in case of a unit B located in proximity to the unit A, or in case of both units A and B located in proximity or in the user apparatus or in household apparatuses near to each other, the connection of the two units A and B is based on the technology distinctive of radiofrequency passive electrical devices without autonomous power supply, also known as RFID, transponders or Tags. Such radiofrequency devices are per se known and do not require in-depth description. In this case, it should be borne in mind that a passive transponder is an electrical device bearing data and without a battery, which reacts to a specific inductive electromagnetic field generated by a respective reader, providing—in response—a modulated radiofrequency representative of data; having no source of internal energy, the passive transponders draw their power from the same electromagnetic field generated by the reader.

Thus, in the considered embodiment, the control means 11 include transponder reader means and the detection means 12, without power supply wires or a battery, comprise, alongside the sensor 53, a respective electronic control circuit which, implementing the functions of a transponder, is capable of obtaining its power supply voltage extracting energy from the electromagnetic field generated by the radiofrequency signal radiated by the abovementioned transponder reader means. The abovementioned circuit implemented in the detection means 12 is prearranged for transmitting to said reader means, in presence of the abovementioned radiofrequency signal radiated by the same reader means, the data representing detection performed by means of the sensor 53.

Regardless of the solution implemented, the possibility of placing the two functional units A and B in wireless signal communication guarantees high flexibility when positioning the detection unit B, both in the environment in which the apparatus provided with the safety device is installed and directly in the apparatus. An example in such sense is that of installing one or more units A in a cooker or in a cooking hob and then installing a unit B in a suction hood installed above such cooker or cooking hob.

In the case of a unit B installed in a suction hood, or in any other household appliance located near the apparatus bearing the unit A, a single sensor 53 and/or a single unit B may transmit a signal or a value to one or more units mounted in the user apparatus or cooking hob; the abovementioned sensor 53 or single unit B possibly receiving signals from one or more units A.

As mentioned beforehand, the circuit 20 may control one or more signalling means (whether they are light sources and/or displays and/or acoustic signals), which in the circuit examples of FIGS. 5 and 6 are represented by the light emitting diode 26. In an embodiment, the diode 26 is mounted on the printed circuit board 13*a* and, through light guides, the generated light signal may be conveyed in determined areas, for example on the knob 6 or on the front part of the structure 7 of the apparatus.

In an embodiment, autonomous power supply means, aimed at guaranteeing the safety function even in absence of power supply from the mains, are associated to the functional units A and B (in case of standard wireless connection of the two units) or to the functional unit A (in case of wired connection or RFID connection of the two units). These supply means may for example comprise a known buffer battery.

In a particularly advantageous embodiment, the means for supplying power to the unit A comprise a thermoelectric generator, which may be made up of a second thermocouple, or by a double or multiple thermocouple, with at least three conductors, used, as an alternative to the previous one indicated with 8, both for providing the current that supplies the solenoid for keeping the safety valve in the respective open condition and for providing supply voltage to the circuit 13.

Given that the voltage generated by a thermocouple is usually low (a few hundreds of millivolts), this voltage may be advantageously increased by using a voltage booster circuit of a known type, to a value suitable to guarantee the supply of the control circuit and the respective devices or controllable switches, which shall preferably be made up of low consumption electronic switches. Voltage booster circuits of this type, in form of integrated circuits, are for example those of the S-882Z series produced and sold by Seiko Instruments Inc., to whose technical documents (see for example http://www.sii.co.jp/info/eg/soi1.html) reference shall be made for further details.

For the possible use of electronic switch means, such as relays, low consumption solutions may be used, such as for example using bi-stable relays or relays that require a high voltage pulse for the closure and a low consumption pulse in maintenance (i.e. substantially with a type of operation similar to that of the solenoid of the safety valve of the tap).

In an embodiment, the circuit 13 of the device according to the invention is configured for interfacing with, and for transmitting information to, an external display module; such display module may be optional, or it may be mounted or not mounted on the apparatus provided with at least one tap having a control device according to the invention associated, or associated to other household apparatus. In such embodiment, the abovementioned module receives signals from the functional unit A, particularly information regarding the safety intervention, or a value or data to be displayed, such as a concentration value of the detected gas.

Figure 8:
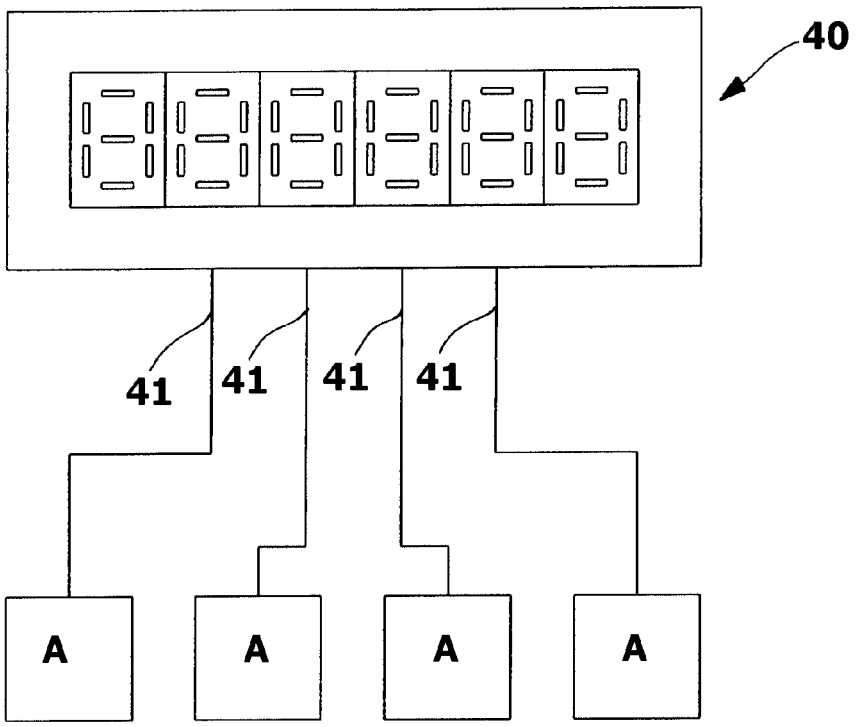
FIGS. 8, 9 and 10 are schematic representations of a fourth, a fifth and a sixth embodiment of the invention, respectively.

Obviously, when several units A are connected to the display module, the safety intervention or the data of each unit A may be displayed on a single display belonging to the abovementioned module. For connection purposes, the circuit of each unit A is equipped with an electric connection (such as a small connector obtained from a PCB with two terminals) for transmitting and/or receiving data with respect to the display module, preferably a transmission and/a or reception of serial data. Even the communication format or protocol between the unit A and the display module may be of any type; not necessarily serial; likewise, the connection may be wired or wireless. A schematic example of the abovementioned display module is represented in FIG. 8, where the display module is indicated with 40 and connected with a data line 41 to respective units A, represented solely schematically. The display module 40 may be at a remote position with respect to the apparatus provided with the safety device A, B, for example mounted in a suction hood beneath which is a cooking hob provided with one or more safety devices according to the invention, or it could be incorporated in the apparatus.

Though being an optional element, the display module according to the proposed variant allows producing safety devices with simplified base structure and thus low cost. As a matter of fact, units A of the safety devices may always be the same (low cost standard product), and useable or non-useable in combination with an additional display module 40, depending on the requirements. Such solution also allows obtaining safety device and the display module 40 with components having different characteristics of resistance to operative temperatures.

Figure 9:
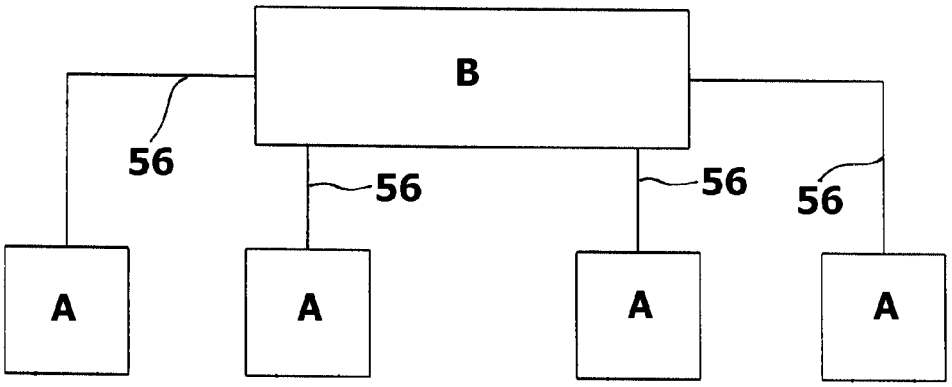
Figure 10:
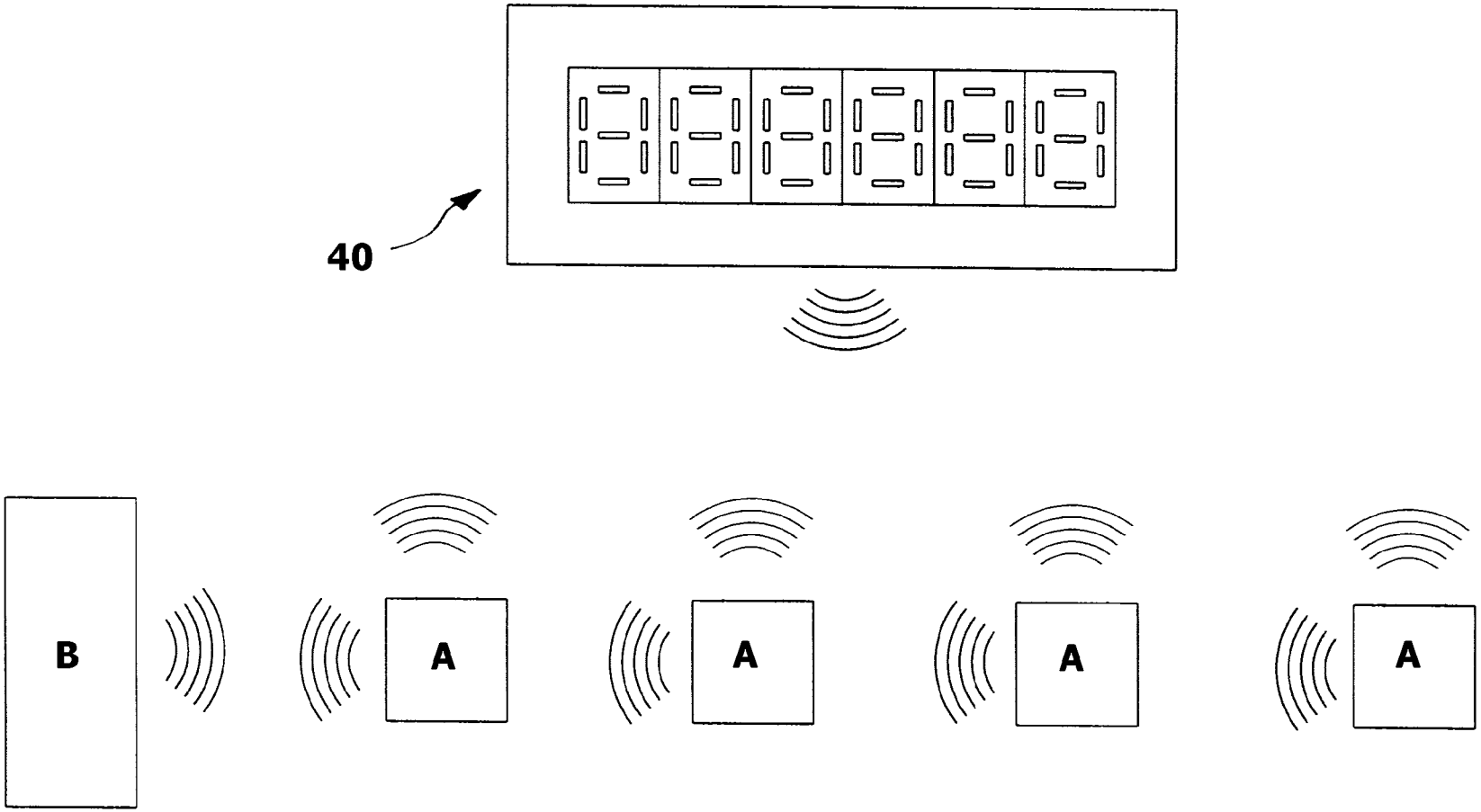

FIG. 9 illustrates an embodiment according to which a plurality of control units A, represented solely schematically, are operatively associated to the same detection unit B in a wired manner. Obviously, the same concept is also applicable in the case of a wireless connection, for example as shown in FIG. 10. Furthermore, in such FIG. 10, even the display module 40 communicates with one or more units A in a wireless manner, and it is provided—for such purpose—with a suitable receiver or wireless transceiver. Thus, in the embodiments of FIGS. 9 and 10 a single detection unit B may transmit information to all units A associated to respective taps 1, which individually control the respective thermocouple.

In the control logic implemented by circuit 13 and/or by circuit 52 criteria or algorithms are preferably implemented, for estimating or deducing whether a possible gas detection performed by the sensor 53 is to be considered potentially dangerous.

A possible criterion is for example based on the switching of the control element represented by the switch 27 of FIGS. 5 and 6. The signal generated by such switching informs the control circuit 20 that the user of the apparatus is trying to ignite the burner 9. In such step, evidently low amounts of combustible may leak from the burner, especially when the ignition of the flame is not successful at the first attempt, which—though not dangerous—may be detected by the sensor 53, especially in cases where it is installed directly on the apparatus, at a burner. For such purpose, the control logic may be implemented in such a manner that the detection of combustible gas detected in the environment within a given time interval (for example 10 seconds) after switching the element 27 is not considered dangerous, and thus does not cause the opening of the thermocouple circuit. In cases where the presence of combustible gas remains after the abovementioned time interval, the thermocouple circuit is opened, with the ensuing closure of the safety valve of the tap 1.

Another possible criteria which may be implemented in the control logic, additionally or alternatively to the previous one, is that of comparing the signal generated by the thermocouple 8 and that detected by the gas sensor 53. Such logic, likewise to the previous one, is advantageously—but not exclusively—useable in the case of apparatuses having a single burner, even of the type in which the flame is ignited in the absence of an ignition system. Like in the previous case, before obtaining the ignition of the flame at the burner, there may be a leak of unburnt gases. In order to avoid the activation of the safety device, especially in applications in which the detection unit B is mounted at a position relatively proximal to the burner, the control logic may be implemented so that the detection of combustible gas in the environment, followed within a brief time interval (for example 10 seconds) by the detection of the electric signal of the thermocouple 8 (performed by the voltage or current sensor 23), is not considered dangerous, and thus it does not cause the opening of the thermocouple circuit. Vice versa, in case the gas detection remains, after the initial detection of the sensor 53 and in the absence of a thermocouple signal, the circuit of the latter is opened, with the ensuing closure of the safety valve of the tap 1.

Another possible criterion is that of performing a sequence of detections, by means of the sensor 53, for example at predetermined time intervals. If after a brief time interval after an ignition attempt interval or the ignition of the burner (detected for example through the switching of the contact 27 or through the presence of the signal generated by the thermocouple) the presence of the combustible gas is detected by the sensor 53, this presence is ignored and considered not dangerous. However, at the subsequent detection (for example after 5 seconds from the previous one) should the gas detection condition by the sensor 53 remain, a potentially dangerous situation is inferred, with the ensuing intervention of the safety device.

A further possible criterion, still based on a sequence of measurements, consists in verifying whether the concentration of the gas possibly detected by the sensor 53 increases or not. For example, if the sensor 53 detects a presence of gas, the control logic waits for a predetermined period of time, for example a few seconds, and performs a second reading. Should the gas concentration detected at the second reading be higher than the previous one, then the device intervenes, causing the closure of the safety valve of the tap. Vice versa, should the concentration detected at the second reading be lower than the previous one, a third reading is performed through the sensor 53: should the concentration reveal a decreasing value it is inferred that the situation is not dangerous (for example the ignition of the burner with slight leakage of combustible gas); otherwise, the device proceeds to subsequent further detections, so as to verify the concentration trend of the detected gas (increasing or reducing), so as to intervene suitably (command or not command the closure of the safety valve of the tap).

In such implementation, a gas concentration threshold value, the exceeding of which—detected through the sensor 53—causes the start of the procedure described above, may be possibly memorized in the control logic of the device. Also in this embodiment the device according to the invention may be constantly active, regarding the detection performed by the sensor 53, or the afore described procedure is activated or not following an ignition attempt or the ignition of the burner, detected for example through the switching of the contact 27 or through the presence of the signal generated by the thermocouple.

Characteristics and advantages of the present invention are clear from the description outlined above. The described device has a simple structure, is small in size, easy to mount, and safe to use. The device is also versatile in use given that it may be structurally conceived to be mounted on conventional taps, without modifying the latter. On the other hand, the detection unit B may be installed where required, installation flexibility having been considerably increased in the previously described wireless connection, also when based on the RFID technology.

The invention finds preferable application in the domestic appliances industry for cooking, such as cooking hobs, ovens, cookers, but it shall be observed that the described control device is suitable for use in other types of apparatus, in which a gas burner is controlled through a respective tap, such as for example boilers for household systems or wall-mounted boilers in buildings, for example such as the safety for switching OFF after a preset period of time.

It is obvious that the device described as an example may be subjected—by a man skilled in the art—to various variants without departing from the scope of protection of the invention as defined by the attached claims. Variants, components and solutions described previously with reference to an implementation or embodiment may be combined and/or interchanged with variants, components and solutions described previously with reference to a different implementation or embodiment, also for obtaining devices different from those exemplified herein.

In a possible embodiment, at least one part of the control electronics of the device according to the invention is housed in the knob of the tap, and is in signal communication with the remaining part of the electronic system, housed in the functional unit A; the connection between the two circuit parts is obtainable, for example, through connection in radiofrequency or with RFID technology, or wired, with conductors rotating with the knob 6 or with rotating/sliding contacts.

The previously described embodiments refer to the application of the invention with taps conceived conventionally, wherein the actuation shaft is rotatable and translatable axially. However, the principles of the invention may also be applied to taps with different actuation and/or control movements, or to taps whose actuation shaft is replaced or actuated through an electric actuator (substantially adjustable solenoid valves).

In the description according to the circuit diagrams of FIGS. 5 and 6, the sensor 23 is a current sensor, but as explained, the same functions may be obtained by using a voltage sensor, for example connected in such a manner to detect the voltage at the tips of the winding of the solenoid; such case is exemplified, in FIGS. 5 and 6, by the dashed line between the connection of the solenoid SV and the sensor 23.

A gas sensor, of the type previously indicated with 53 could advantageously be integrated in the unit A associated to the tap 1, for example for detecting local gas leakages.

The gas sensor may be of the type adapted to detect and/or discriminate at least one from among the presence, the amount/concentration, the type of gas, in particular the combustible gas and/or the type of additive mixed with gas to make it detectable and/or the type of a gas deriving from combustion and/or chemical reactions.

The invention claimed is:

1. A safety device against gas leaks or emissions for a household cooking apparatus having (a) a housing structure, (b) at least one gas burner, and (c) at least one gas tap, wherein the gas tap includes:

a tap body, having an inlet configured for connection to a gas supply line, and an outlet configured for connection to a conduit for delivering gas to a corresponding gas burner of the household cooking apparatus, an actuation shaft mounted on the tap body and projecting from an end thereof, the actuation shaft being operable for adjusting a gas flow from the inlet to the outlet of the tap body, a manually operable control member coupled to an outer end of the actuation shaft, at least one portion of the tap body being configured to be installed within the housing structure of the household cooking apparatus with at least the outer end of the actuation shaft that projects outside said housing structure, to be operable via the manually operable control member, a safety valve in the tap body, having a solenoid configured to be electrically supplied through a thermoelectric generator having a sensitive part in proximity of said gas burner, in such a way that the thermoelectric generator generates an electric current in response to heat generated by a flame at said gas burner to supply the solenoid, that maintains the safety valve in an open condition in which gas supply to said gas burner is allowed, wherein the safety device comprises:

a control circuit, an electrical safety arrangement, a detection circuit, for detecting possible presence of gas in a surrounding environment, wherein the detection circuit is in signal communication with the control circuit and the control circuit is configured for controlling the electrical safety arrangement in function of detections carried out by the detection circuit, in order to prevent or interrupt inflow of the gas from the tap body to said gas burner, wherein the electrical safety arrangement is electrically controllable by the control circuit for interrupting or reducing supply of said electric current to the solenoid of the safety valve following upon a command signal generated by the detection circuit, and causing as a consequence changeover of the safety valve to a closed condition in which gas supply to said gas burner is interrupted, wherein the control circuit and the electrical safety arrangement are integrated in a control module having a housing body configured for mechanical coupling or assembly directly on a portion of the tap body which is within the housing structure of the household cooking apparatus, wherein the housing body of the control module has an electric connector, for electrical connection to a connection part of the thermoelectric generator which is opposite to said sensitive part, and electric connection elements, for electrical connection to the solenoid of the safety valve, the electrical safety arrangement being electrically connected between said electric connector and said electric connection elements, wherein the safety device further comprises at least one of a visual signaling arrangement and an acoustic signaling arrangement, controlled by the control circuit for generating at least one of a visual signal and an acoustic signal for a user upon detection of presence of gas by the detection circuit.

2. The safety device according to claim 1, wherein at least one of the detection circuit and the control circuit is configured for communicating in a wired manner.

3. The safety device according to claim 1, wherein the control circuit comprises an activation switch operable by the user, the control circuit being rendered active by an activation command causes by a switching of the activation switch by the user.

4. The safety device according to claim 3, wherein the activation switch is operatively associated to one of said actuation shaft and said manually operable control member, said switching being caused by a displacement of the manually operable control member by the user.

5. The safety device according to claim 1, wherein the housing body comprises at least one coupling element for coupling or hooking to the tap body.

6. The safety device according to claim 5, wherein the at least one coupling element comprises a seat defined in the housing body and configured for housing at least a part of the tap body.

7. The safety device according to claim 6, wherein the seat has a profile matching a profile of said part of the tap body.

8. The safety device according to claim 1, wherein the control module includes at least one connector for electrical connection of the control circuit to at least one of the solenoid of the safety valve or the thermoelectric generator or an electric supply source of the control module.

9. The safety device according to claim 1, wherein said electric connector comprises a connector element at a distal end of the housing body, made of electrically conductive material and configured for electrical and mechanical coupling with an end connection element of said connection part of the thermoelectric generator.

10. The safety device according to claim 1, wherein said electric connector is a quick-coupling connector.

11. The safety device according to claim 1, wherein the electrical safety arrangement comprise a controllable switch, selected from among electromechanical switches and electronic switches.

12. The safety device according to claim 1, further comprising at least one of an autonomous supply source, or a control system for a gas igniter operable to cause gas ignition at said gas burner.

13. The safety device according to claim 1, wherein the detection circuit is integrated in a detection module having a housing body which is separate from the housing body of the control module.

14. The safety device according to claim 13, comprising a plurality of said control modules, each of which is connected in signal communication with the detection circuit of one and the same detection module.

15. The safety device according to claim 1, wherein the electrical safety arrangement comprise a controllable circuit arrangement configured for varying an electric circuit of the thermoelectric generator or of the solenoid, the circuit arrangement being controllable for reducing said electric current supplied by the thermoelectric generator to the solenoid of the safety valve.

16. The safety device according to claim 1, wherein at least one of the detection circuit and the control circuit is configured for communicating in a wireless manner.

17. The safety device according to claim 1, wherein the control module comprises a printed circuit board within the housing body, mounted on which are circuit components of the control circuit and of the electrical safety arrangement, the circuit components including a connection interface for connecting in signal communication the control circuit to the detection circuit.

18. The safety device according to claim 1, wherein the housing body is made at least in part of an insulating material.

19. A method of using a safety device, wherein the method includes:

Providing and using a safety device against gas leaks or emissions for a household cooking apparatus having (a) a housing structure, (b) at least one gas burner, and (c) at least one gas tap, wherein the gas tap includes:

a tap body, having an inlet configured for connection to a gas supply line, and an outlet configured for connection to a conduit for delivering gas to a corresponding gas burner of the household cooking apparatus, an actuation shaft mounted on the tap body and projecting from an end thereof, the actuation shaft being operable for adjusting a gas flow from the inlet to the outlet of the tap body, a manually operable control member coupled to an outer end of the actuation shaft, at least one portion of the tap body being configured to be installed within the housing structure of the household cooking apparatus with at least the outer end of the actuation shaft that projects outside said housing structure, to be operable via the manually operable control member, a safety valve in the tap body, having a solenoid configured to be electrically supplied through a thermoelectric generator having a sensitive part in proximity of said gas burner, in such a way that the thermoelectric generator generates an electric current in response to heat generated by a flame at said gas burner to supply the solenoid, that maintains the safety valve in an open condition in which gas supply to said gas burner is allowed, wherein the safety device comprises:

a control circuit, an electrical safety arrangement, a detection circuit, for detecting possible presence of gas in a surrounding environment, wherein the detection circuit is in signal communication with the control circuit and the control circuit is configured for controlling the electrical safety arrangement in function of detections carried out by the detection circuit, in order to prevent or interrupt inflow of the gas from the tap body to said gas burner, wherein the electrical safety arrangement is electrically controllable by the control circuit for interrupting or reducing supply of said electric current to the solenoid of the safety valve following upon a command signal generated by the detection circuit, and causing as a consequence changeover of the safety valve to a closed condition in which gas supply to said gas burner is interrupted, wherein the control circuit and the electrical safety arrangement are integrated in a control module having a housing body configured for mechanical coupling or assembly directly on a portion of the tap body which is within the housing structure of the household cooking apparatus, wherein the housing body of the control module has an electric connector, for electrical connection to a connection part of the thermoelectric generator which is opposite to said sensitive part, and electric connection elements, for electrical connection to the solenoid of the safety valve, the electrical safety arrangement being electrically connected between said electric connector and said electric connection elements, wherein the safety device further comprises at least one of a visual signaling arrangement and an acoustic signaling arrangement, controlled by the control circuit for generating at least one of a visual signal and an acoustic signal for a user upon detection of presence of gas by the detection circuit.

20. The method of using a safety device according to claim 19, wherein the tap is a tap in which at least one of the command means and the actuating shaft is adapted to rotate and/or translate in a respective actuation or control direction, in particular for causing at least one initial opening of the valve.

21. A gas-supplied apparatus comprising a safety device and (a) a housing structure, (b) at least one gas burner, and (c) at least one gas tap, wherein the gas tap includes:

a tap body, having an inlet configured for connection to a gas supply line, and an outlet configured for connection to a conduit for delivering gas to a corresponding gas burner of the household cooking apparatus, an actuation shaft mounted on the tap body and projecting from an end thereof, the actuation shaft being operable for adjusting a gas flow from the inlet to the outlet of the tap body, a manually operable control member coupled to an outer end of the actuation shaft, at least one portion of the tap body being configured to be installed within the housing structure of the household cooking apparatus with at least the outer end of the actuation shaft that projects outside said housing structure, to be operable via the manually operable control member, a safety valve in the tap body, having a solenoid configured to be electrically supplied through a thermoelectric generator having a sensitive part in proximity of said gas burner, in such a way that the thermoelectric generator generates an electric current in response to heat generated by a flame at said gas burner to supply the solenoid, that maintains the safety valve in an open condition in which gas supply to said gas burner is allowed, wherein the safety device comprises:

a control circuit, an electrical safety arrangement, a detection circuit, for detecting possible presence of gas in a surrounding environment, wherein the detection circuit is in signal communication with the control circuit and the control circuit is configured for controlling the electrical safety arrangement in function of detections carried out by the detection circuit, in order to prevent or interrupt inflow of the gas from the tap body to said gas burner, wherein the electrical safety arrangement is electrically controllable by the control circuit for interrupting or reducing supply of said electric current to the solenoid of the safety valve following upon a command signal generated by the detection circuit, and causing as a consequence changeover of the safety valve to a closed condition in which gas supply to said gas burner is interrupted, wherein the control circuit and the electrical safety arrangement are integrated in a control module having a housing body configured for mechanical coupling or assembly directly on a portion of the tap body which is within the housing structure of the household cooking apparatus, wherein the housing body of the control module has an electric connector, for electrical connection to a connection part of the thermoelectric generator which is opposite to said sensitive part, and electric connection elements, for electrical connection to the solenoid of the safety valve, the electrical safety arrangement being electrically connected between said electric connector and said electric connection elements, wherein the safety device further comprises at least one of a visual signaling arrangement and an acoustic signaling arrangement, controlled by the control circuit for generating at least one of a visual signal and an acoustic signal for a user upon detection of presence of gas by the detection circuit.

* * * * *